US009002249B2

(12) United States Patent
Uekawa et al.

(10) Patent No.: US 9,002,249 B2
(45) Date of Patent: Apr. 7, 2015

(54) IMAGE HEATING APPARATUS REGULATING A SHIFT MOVEMENT OF AN ENDLESS BELT THE INNER FACE OF WHICH CONTACTS A NIP PORTION FORMING UNIT FORMING A NIP PORTION WITH A ROLLER CONTACTING AN OUTER FACE OF THE BELT

(71) Applicant: Canon Kabushiki Kaisha, Tokyo (JP)

(72) Inventors: Eiji Uekawa, Susono (JP); Tohru Saito, Mishima (JP); Atsutoshi Ando, Yokohama (JP); Masashi Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 128 days.

(21) Appl. No.: 13/855,314

(22) Filed: Apr. 2, 2013

(65) Prior Publication Data

US 2013/0272762 A1 Oct. 17, 2013

(30) Foreign Application Priority Data

Apr. 11, 2012 (JP) ..... 2012-089998

(51) Int. Cl.
*G03G 15/20* (2006.01)

(52) U.S. Cl.
CPC ..... *G03G 15/2064* (2013.01); *G03G 15/2017* (2013.01); *G03G 2215/2035* (2013.01)

(58) Field of Classification Search
USPC ..... 399/329
See application file for complete search history.

(56) References Cited

U.S. PATENT DOCUMENTS

| | | | | |
|---|---|---|---|---|
| 5,752,149 | A * | 5/1998 | Yuza et al. | 399/329 |
| 7,130,572 | B2 * | 10/2006 | Kubochi et al. | 399/329 |
| 7,177,579 | B2 | 2/2007 | Uchida et al. | |
| 7,203,438 | B2 | 4/2007 | Omata et al. | |
| 7,209,696 | B2 | 4/2007 | Umezawa et al. | |
| 7,215,899 | B2 | 5/2007 | Kimizuka et al. | |
| 7,251,447 | B2 | 7/2007 | Kanamori et al. | |
| 7,283,763 | B2 | 10/2007 | Akizuki et al. | |
| 7,428,390 | B2 | 9/2008 | Ando | |
| 7,512,370 | B2 | 3/2009 | Shimizu et al. | |
| 7,518,089 | B2 | 4/2009 | Hashiguchi et al. | |
| 7,570,895 | B2 | 8/2009 | Ando et al. | |
| 7,650,105 | B2 | 1/2010 | Ogawa et al. | |
| 7,792,448 | B2 | 9/2010 | Ando et al. | |
| 8,112,024 | B2 | 2/2012 | Saito et al. | |
| 8,131,197 | B2 * | 3/2012 | Hiraoka et al. | 399/329 |
| 8,265,507 | B2 | 9/2012 | Saito et al. | |

(Continued)

FOREIGN PATENT DOCUMENTS

| | | |
|---|---|---|
| JP | 04-204980 A | 7/1992 |
| JP | 05-208750 A | 8/1993 |

*Primary Examiner* — William J Royer
(74) *Attorney, Agent, or Firm* — Fitzpatrick, Cella, Harper & Scinto

(57) ABSTRACT

The image heating apparatus includes an endless belt, a roller which contacts an outer face of the belt, and a nip portion forming unit which contacts an inner face of the belt, and forms a nip portion with the roller, for nipping and conveying a recording material. The nip portion forming unit includes a component which is longer than the belt in a generatrix direction of the belt. The apparatus also includes a regulation portion provided to oppose an end face of the belt, for regulating a shift movement of the belt to the generatrix direction of the belt. The regulation portion is integrally-molded with the component. As a result, damage of the end of the endless belt can be reduced.

12 Claims, 12 Drawing Sheets

(56) References Cited

U.S. PATENT DOCUMENTS

| | | | | |
|---|---|---|---|---|
| 8,364,067 | B2 | 1/2013 | Miki et al. | |
| 8,447,218 | B2 * | 5/2013 | Yamana | 399/329 |
| 2011/0236084 | A1 | 9/2011 | Nishida et al. | |
| 2011/0305474 | A1 | 12/2011 | Tanaka et al. | |
| 2012/0027479 | A1 | 2/2012 | Uekawa et al. | |
| 2012/0063823 | A1 | 3/2012 | Ando et al. | |
| 2012/0076555 | A1 | 3/2012 | Ikegami et al. | |
| 2012/0099882 | A1 | 4/2012 | Tanaka | |
| 2012/0155938 | A1 | 6/2012 | Tanaka et al. | |
| 2012/0308279 | A1 | 12/2012 | Tanaka et al. | |
| 2013/0129364 | A1 | 5/2013 | Kitagawa et al. | |
| 2013/0206745 | A1 | 8/2013 | Tanaka et al. | |
| 2013/0302046 | A1 * | 11/2013 | Monde et al. | 399/33 |

* cited by examiner

IMAGE HEATING APPARATUS REGULATING A SHIFT MOVEMENT OF AN ENDLESS BELT THE INNER FACE OF WHICH CONTACTS A NIP PORTION FORMING UNIT FORMING A NIP PORTION WITH A ROLLER CONTACTING AN OUTER FACE OF THE BELT

BACKGROUND OF THE INVENTION

Field of the Invention

The present invention relates to an image heating apparatus which can be used as a fixing apparatus (fixing device) that is mounted in an image forming apparatus such as an electrophotographic copier and an electrophotographic printer.

A film (belt) heating type of fixing apparatus is known as a fixing apparatus (fixing device) which is mounted in an electrophotographic copier and an electrophotographic printer. This film heating type of fixing apparatus has a heater having a current-energized heat generating member on a substrate made from ceramic, a cylindrical fixing film (endless belt) which rotates while coming into contact with the heater, and a pressure roller which forms a nip portion with the heater through the fixing film. A recording material, which carries an unfixed toner image thereon, is heated while being sandwiched in the nip portion and conveyed therethrough, and thereby, a toner image on the recording material is heated and fixed onto the recording material.

This type of fixing apparatus has the advantage that the period of time for raising the temperature of the heater to a fixable temperature after the energization to the heater has started is short. Accordingly, a printer having this fixing apparatus mounted therein can shorten the period of time (FPOT: First Print Out Time) for outputting the first sheet of an image after a command to print has been input thereinto. This type of fixing apparatus has also the advantage of consuming little electric power while waiting for the command to print.

A resin film or a metal sleeve is used as the fixing film. When the resin film and the metal sleeve are not distinguished from each other in the following description, the resin film and the metal sleeve shall be altogether referred to as a fixing film. There are many cases where the fixing film receives a shift force toward any one direction in a longitudinal direction (generatrix direction) of the fixing film, due to the influences of a balance in alignment with the pressure roller, the difference between outer diameters of both ends of the fixing film in the longitudinal direction, and the introduction (sheet-feeding) of the recording material to the nip portion.

Japanese Patent Application Laid-Open No. H04-204980 and Japanese Patent Application Laid-Open No. H05-208750 disclose a method for providing a shift regulation portion (regulation flange) at the outside of both ends in the longitudinal direction of the fixing film so as to regulate a shift of the fixing film to the longitudinal direction, thereby preventing damage and wear at the end in the longitudinal direction of the fixing film.

An assembled structure of the regulation flange in the fixing apparatus of a comparative example will be described below with reference to FIGS. 13 to 15. FIG. 13 illustrates the assembled structure of a regulation flange 101 at one end side of a fixing film 104 in a longitudinal direction, but the assembled structure of the regulation flange at the other end side of the fixing film 104 in the longitudinal direction also has the same structure as that at the one end side.

The regulation flange 101 has a regulation portion 101*a* having an end regulation face 101*a*1 for regulating the shift of the fixing film 104 to the longitudinal direction, a spring receiving portion 101*b* for holding one end of a pressure spring 103, a guide portion 101*c* for guiding the trajectory of the fixing film 104 during rotation, and the like. The bottom parts of the regulation portion 101*a* and the guide portion 101*c* of the regulation flange 101 support one end of a heater (not-shown) in a longitudinal direction, and the guide portion 101 *c* supports the one end of the fixing film 104 in the longitudinal direction.

A groove for guiding the regulation flange 101 is provided on a frame member 102 (fixing frame) of the fixing apparatus. In the regulation flange 101, a groove portion 101*d*(see FIG. 15) provided on the regulation flange 101 fits into the groove of the frame member 102, thereby determining the position of the regulation portion 101*a*Alternatively, the position of the regulation portion 101*a* is determined by fitting of the groove portion 101*d* provided on the regulation flange 101 into a part of an unillustrated frame member (main body frame) of the main body of the image forming apparatus. A pressure force due to the pressure spring 103 is applied to the spring receiving portion 101*b*, and the pressure force due to the pressure spring 103 forms a fixing nip portion.

Here, suppose the case where the whole regulation flange 101 tilts downward at the outer side in the longitudinal direction of the fixing film 104, due to a factor such as an assembly tolerance (see FIG. 14). In the state in which the whole regulation flange 101 tilts as is illustrated in FIG. 14, a shift force may be generated in a direction shown by an arrow in the fixing film 104 while the fixing film 104 is rotated, and the end face of one end in the longitudinal direction of the fixing film 104 may abut on the regulation face 101*a*1. In this case, in a portion that is close to the fixing nip portion surrounded by a circular chained line S1, the end face of the one end in the longitudinal direction of the fixing film 104 locally comes into contact with the regulation face 101*a*1.

If a strong shift force has acted on the fixing film 104 in such a state that the regulation flange 101 tilts as in the above description, the end in the longitudinal direction of the fixing film 104 (hereinafter referred to as the film end) receives a stress and is facilitated to be bent.

In addition, such an action becomes so strong that the guide portion 101*c* of the regulation flange 101 expands an inner peripheral face (inner face) of the fixing film 104 to the outside, in a portion surrounded by a circular chained line S2, thereby increasing the risk that this stress damages the end in the longitudinal direction of the fixing film 104.

In addition, there is also the case where the whole regulation flange 101 tilts toward the upstream side of the recording-material-conveyance direction because of a factor such as the assembly tolerance (see FIG. 15), or where the whole regulation flange 101 tilts toward the downstream side of the recording-material-conveyance direction. If a shift force has been generated in the fixing film 104 in a direction shown by an arrow while the fixing film 104 is rotated in a state in which the whole regulation flange 101 tilts toward the upstream side of the recording-material-conveyance direction as is illustrated in FIG. 15, the shift force acts on portions S3 and S4 shown by a circular dashed lines in a similar way. Because of this, the action of the shift force results in increasing the risk of damaging the end in the longitudinal direction of the fixing film 104.

In order to reduce such a risk, various measures are implemented which include, for instance, reducing the fitting clearance of the frame member 102 of the fixing apparatus or the regulation flange 101 with respect to the frame member of the main body of the image forming apparatus, and forming the shape of the end regulation face 101*a*1 into a curved surface.

However, it is difficult to eliminate the tilt of the whole regulation flange 101, and the damage of the end and the wear of the end in the longitudinal direction of the fixing film 104 have not been solved yet.

Such a problem that the endless belt is damaged is not limited to an apparatus using a ceramic heater, but is a common problem among apparatuses using an endless belt.

SUMMARY OF THE INVENTION

With respect to the above-described problems, a purpose of the present invention is to provide an image heating apparatus which can suppress damage to an endless belt.

Another purpose of the present invention is to provide an image heating apparatus that includes an endless belt, a roller which contacts an outer face of the belt, a nip portion forming unit which contacts an inner face of the belt, and forms a nip portion with the roller, for nipping and conveying a recording material, the nip portion forming unit including a component which is longer than the belt in a generatrix direction of the belt, and a regulation portion provided to oppose an end face of the belt, for regulating a shift movement of the belt to the generatrix direction of the belt. The regulation portion is integrally-molded with the component.

Further features of the present invention will become apparent from the following description of embodiments with reference to the attached drawings.

DESCRIPTION OF THE EMBODIMENTS

Preferred embodiments of the present invention will now be described in detail in accordance with the accompanying drawings.

Embodiment 1

(1) Example of Image Forming Apparatus

Figure 1:
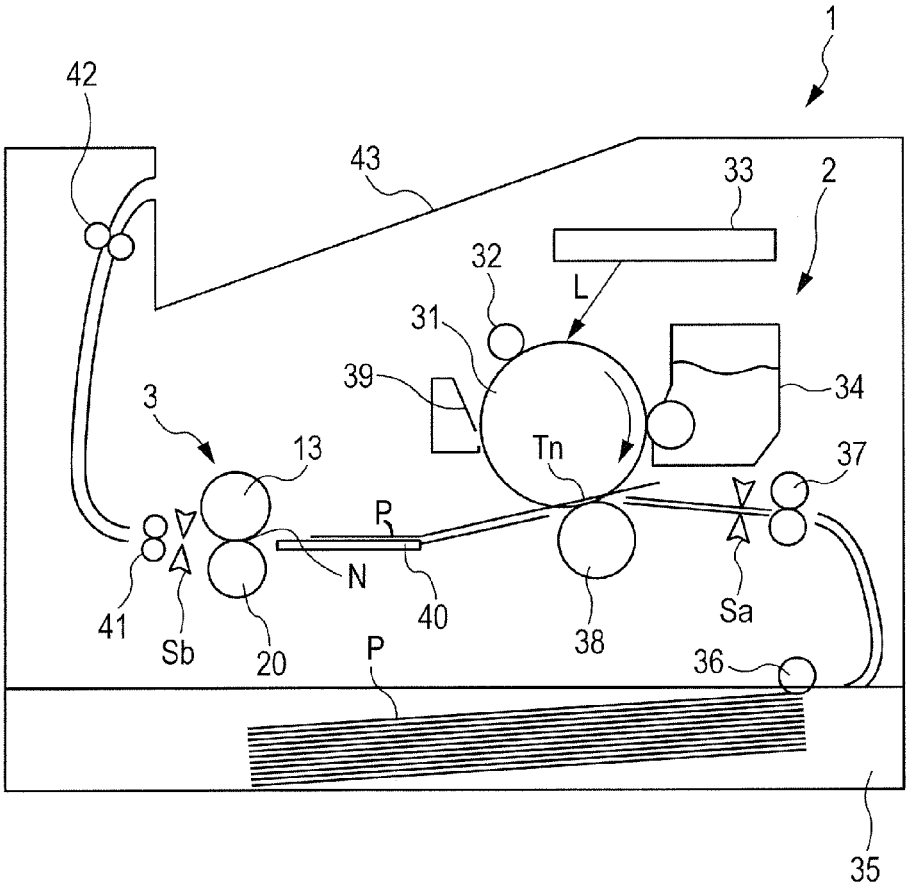
FIG. 1 is a schematic view of a schematic structure of one example of an image forming apparatus.

FIG. 1 is a schematic block diagram of one example of an image forming apparatus having an image heating apparatus mounted therein, as a fixing apparatus according to the present invention. This image forming apparatus is an electrophotographic laser printer.

An image forming apparatus 1 illustrated in the present embodiment has an image-forming portion 2 for forming an unfixed toner image (unfixed image) on a recording material such as a recording paper, a fixing device (fixing portion) 3 for heating the unfixed toner image carried on the recording material and fixing the unfixed toner image onto the recording material, and the like.

In the image forming apparatus 1 of the present embodiment, a cylindrical electrophotographic photosensitive member (hereinafter referred to as a photosensitive drum) of an image carrying body is rotated in a direction shown by an arrow according to a command to print, which is input from an external apparatus (not-shown), such as a host computer. A photosensitive drum obtained by forming a photosensitive material such as OPC, amorphous Se and amorphous Si, on a cylindrical base of aluminum, nickel or the like, is used as a photosensitive drum 31.

When the photosensitive drum 31 is rotated, first, the outer peripheral face (surface) of the photosensitive drum 31 becomes uniformly charged to a predetermined potential/polarity by a charge roller 32 of a charging unit. Next, the charged face of the surface of the photosensitive drum 31 is scanned and exposed by a laser beam L which has been ON/OFF controlled according to image information and is emitted from a laser scanner 33 of an exposure unit, and an electrostatic latent image is formed on the charged face of the surface of the photosensitive drum 31. This electrostatic latent image is developed with the use of a toner in a development apparatus 34 of a development unit, and the developed image is visualized. A jumping development method, a two-component development method, a FEED development method and the like are used as a development method, and are used in combination with image exposure and reversal development in many cases.

On the other hand, a sheet of a recording material P is fed one by one from a feeding cassette 35 by a feeding roller 36, is sandwiched between conveyance rollers 37 and is conveyed (sandwiched and conveyed) in the state. The conveyance rollers 37 are structured so as to send the recording material P to a transfer nip portion Tn, which is formed of the surface of the photosensitive drum 31 and the outer peripheral face (surface) of a transfer roller 38 of a transfer unit at predetermined timing. The conveyance rollers 37 stop the conveyance of the recording material P at timing at which a top sensor Sa has detected the tip of the recording material P. The conveyance rollers 37 convey the recording material P toward the transfer nip portion Tn so that an image formation starting position of the toner image on the surface of the photosensitive drum 31 and a writing position on the tip of the recording material P coincide with each other on the transfer nip portion Tn.

The recording material P is sandwiched in the transfer nip portion Tn, which is formed between the surface of the photosensitive drum 31 and the surface of the transfer roller 38, and is thereby conveyed. In the conveyance process, the toner image on the surface of the photosensitive drum 31 is transferred onto the recording material P by the transfer roller 38. As a result, the recording material P carries an unfixed toner image (unfixed image) on the surface which opposes the photosensitive drum 31.

The transfer remainder toner which remains on the surface of the photosensitive drum 31 after having transferred the toner image to the recording material P is removed by a cleaning blade 39 of a cleaning unit, and thereby the photosensitive drum 31 is supplied to next image formation.

The recording material P having the unfixed toner image carried thereon is separated from the surface of the photosensitive drum 31, and is introduced to a fixing device (hereinafter referred to as a fixing apparatus) 3 through a conveyance guide 40. In the fixing apparatus 3, the recording material P is sandwiched in the fixing nip portion (nip portion) N which is formed by a fixing film 13 of a cylindrical flexible member (endless belt) and a pressure roller 20 of a pressure rotation member, and is conveyed therethrough. As a result, the unfixed toner image is heated and fixed onto the recording material P. The recording material P, which has exited from the fixing nip portion N, is discharged onto a discharge toner 43 by discharge rollers 41 and 42.

An ejected paper sensor Sb is provided between the discharge rollers and the fixing apparatus 3. The ejected paper sensor Sb is a sensor for detecting the jamming of paper when the paper is jammed between the top sensor Sa and the ejected paper sensor Sb.

(2) Fixing Apparatus 3

In the following description, a longitudinal direction of a fixing apparatus and members which constitute the fixing apparatus refers to a direction perpendicular to a recording-material-conveyance direction, on the surface of the recording material. A transverse direction refers to a direction parallel to the recording-material-conveyance direction, on the surface of the recording material. A length denotes a dimension in the longitudinal direction. A width denotes a dimension in the transverse direction. A width direction of the recording material refers to a direction perpendicular to the recording-material-conveyance direction, on the surface of the recording material. The width of the recording material refers to a dimension in the width direction.

Figure 2:
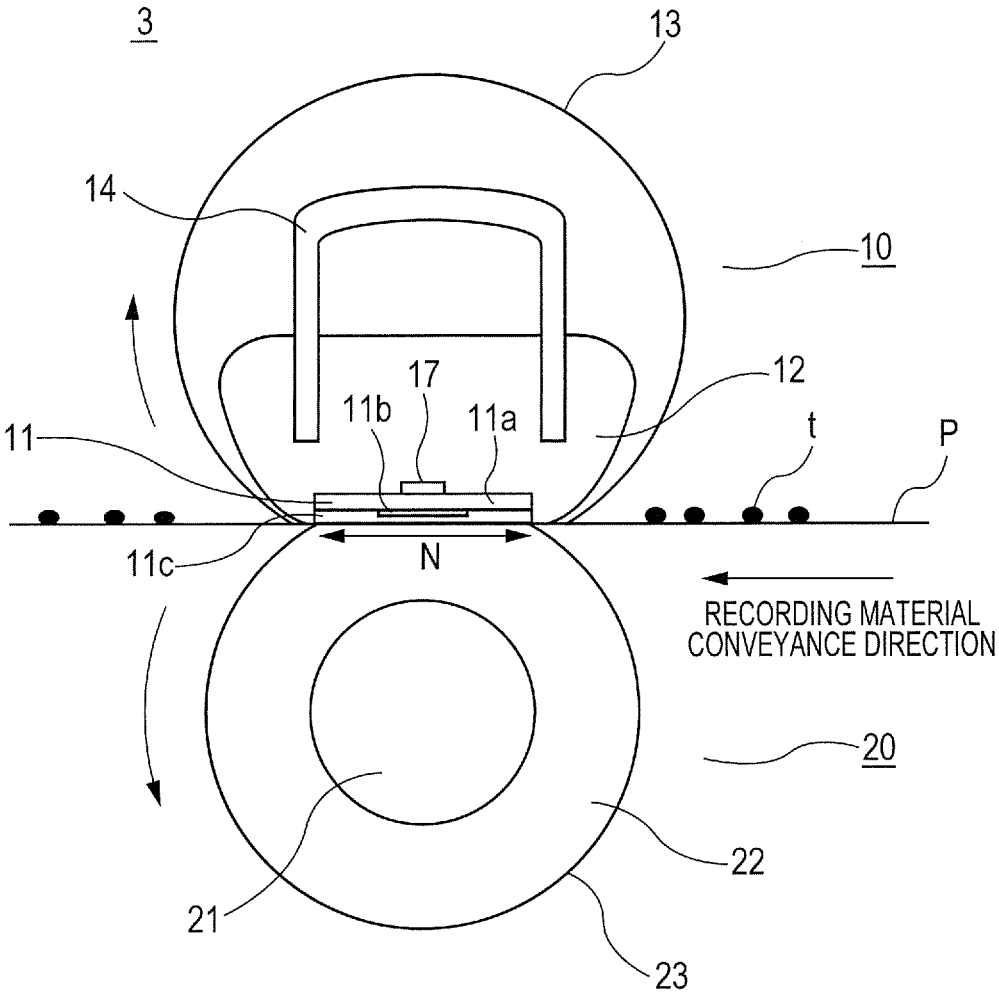
FIG. 2 is a transverse sectional view illustrating a schematic structure at the center in a longitudinal direction of a fixing apparatus according to Embodiment 1.
Figure 3A:
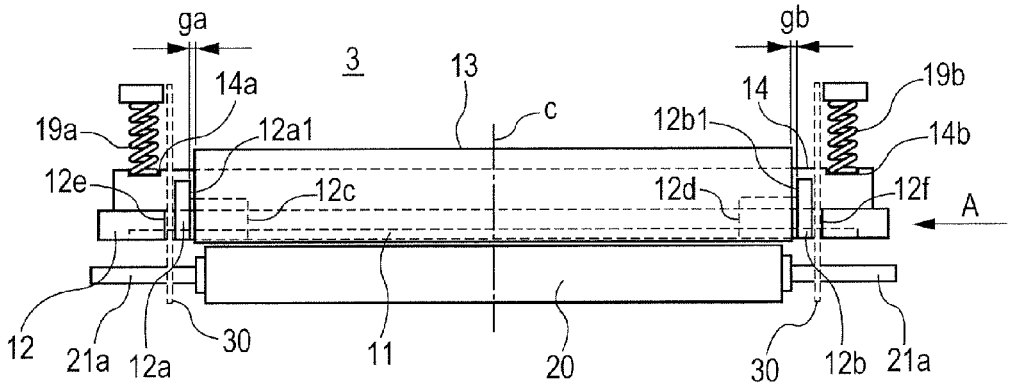
FIG. 3A is a front view illustrating the schematic structure of the fixing apparatus when viewed from a recording-material-introduction.
Figure 3B:
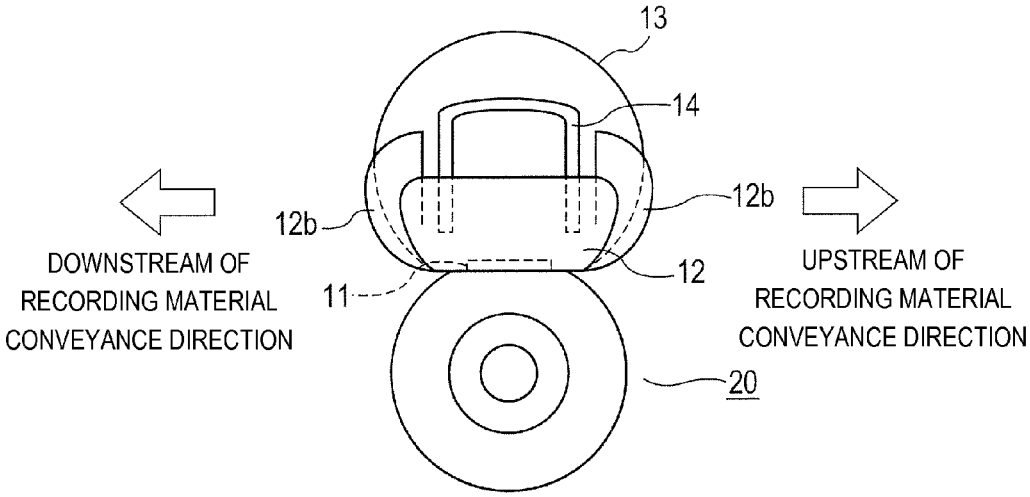
FIG. 3B is an enlarged side view of the fixing apparatus in FIG. 3A when viewed from the direction of the arrow A.
Figure 3C:
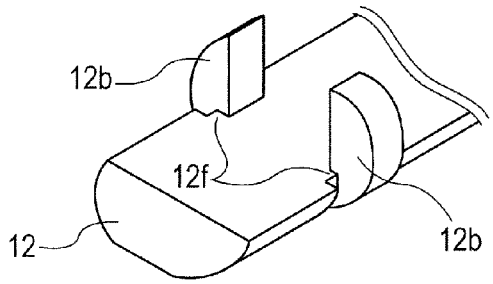
FIG. 3C is a perspective view illustrating an end of a heat insulation holder.

FIG. 2 is a transverse sectional view illustrating a schematic structure, at the center in the longitudinal direction of the fixing apparatus 3. FIG. 3A is a front view illustrating the schematic structure of the fixing apparatus 3 when viewed from a recording-material-introduction side, and FIG. 3B is an enlarged side view of the fixing apparatus 3 of FIG. 3A when viewed from the direction of the arrow A. FIG. 3C is a perspective view illustrating an end of a heat insulation holder. The fixing apparatus is a film heating type of apparatus.

The fixing apparatus 3 illustrated in the present embodiment has a fixing assembly 10, the pressure roller 20 and the like. The fixing assembly 10 has the fixing film (endless belt) 13, a heater 11 as a heating element, a heat insulation holder 12 of a supporting member, a metal stay 14 of a support member, pressure springs 19*a* and 19*b* of a pressure unit, and the like. All of the fixing film 13, the heater 11, the heat insulation holder 12, the metal stay 14, and the pressure roller 20 are members that are long in a longitudinal direction. As is illustrated in FIG. 3A, all of these members are arranged so as to be symmetrical with respect to the center c in the longitudinal direction of the fixing apparatus 3. In addition, the length of these members are set so as to satisfy the relation of pressure roller 20 <fixing film 13 <heater 11 <metal stay 14 <heat insulation holder 12. Among these components, the heater 11, the heat insulation holder 12 and the metal stay 14 constitute a nip portion forming unit which comes into contact with the inner face of the fixing film (belt) 13.

(2-1) Fixing Assembly 10

The heater 11 has low heat capacity, has a plate shape, comes into contact with the inner peripheral face (inner face) of the fixing film 13, and heats the fixing nip portion N. The heater 11 has an insulative ceramic substrate (hereinafter referred to as substrate) 11*a* made from alumina, aluminum nitride or the like. A current-energized resistance layer 11*b* made from Ag/Pd (silver palladium), $RuO_2$, $Ta_2N$ or the like is formed on the surface in the fixing nip portion N side of the substrate 11*a*, along the longitudinal direction of the substrate 11*a*, by screen printing or the like. Furthermore, a protection layer 11*c*, such as a glass layer, for protecting the current-energized resistance layer 11*b*, is formed in such a range as not to impair the thermal efficiency, on the surface in the fixing nip portion N side of the substrate 11*a*.

The heat insulation holder 12 is formed from a heat resistant resin material, such as a liquid crystal polymer, a phenol resin, PPS (polyphenylene sulfide) and PEEK (polyether ether ketone). The heat insulation holder 12 supports the heater 11 so that the protection layer 11*c* faces downward. The metal stay 14, whose cross section has been formed into approximately a U-shape, is arranged in the center of the upper face of the heat insulation holder 12. The outside surfaces on both sides in the transverse direction of the heat insulation holder 12 are formed into such an arcuate surface as to swell to the outside, and the arcuate surface is structured so as to guide the rotation of the fixing film 13. The fixing film 13 is rotatably and loosely fitted over the outer perimeter of the heat insulation holder 12, which supports the heater 11 and the metal stay 14.

The fixing film 13 is a heat resistant film which has a cylindrical shape, has flexibility and a total thickness of 200 μm or less, so as to shorten the period of time until the fixing film 13 is heated to a fixable temperature after the energization to the heater 11 has started. The fixing film 13 employs a heat resistant resin, such as polyimide, polyamide imide and PEEK, a pure metal such as SUS, Al, Ni, Cu and Zn or an alloy which has heat resistance and high heat conductivity, as a base layer. In addition, the fixing film 13 needs to have a total thickness of 20 μm or more from the viewpoint of durability. Accordingly, the total thickness of the fixing film 13 can be 20 μm or more and 200 μm or less.

Furthermore, a releasing layer is formed on the outer peripheral face (surface) of the fixing film 13, in order to prevent an offset of a toner and secure separability from the recording material P. The fixing film 13 is covered with a substance obtained by mixing a heat resistant resin,. having adequate mold releasability, like a fluorine resin such as PTFE, PFA, FEP, ETFE and CTFE and a silicone resin, or with a sole substance thereof, which is used as the releasing layer. Here, PTFE is polytetrafluoroethylene, and PFA is a tetrafluoroethylene perfluoroalkyl-vinyl-ether copolymer. FEP is a tetrafluoroethylene hexafluoropropylene copolymer, ETFE is an ethylene tetrafluoroethylene copolymer, CTFE is polychlorotrifluoroethylene, and PVDF is polyvinylidene-fluoride.

As described above, the fixing assembly 10 having the heater 11, the heat insulation holder 12, the metal stay 14, the fixing film 13 and the like is supported by a part of a frame member 30 (fixing frame) of the fixing apparatus 3, which is shown by a dashed line in FIG. 3A. In more detail, the position of the fixing assembly 10 (to be precise, nip portion forming unit) is determined, by fitting guide grooves 12*e* and 12*f* provided at the ends in the longitudinal direction of the heat insulation holder 12, into the frame member 30.

(2-2) Pressure Roller 20

The pressure roller 20 is an elastic roller that has an elastic layer 22 on the outer peripheral face between shaft portions 21*a* (see FIG. 3A) at both ends in the longitudinal direction of a metallic metal core (hereinafter referred to as a metal core) 21 made from a metal, such as SUS (steel used stainless), SUM (steel used machinability) and A1.

An elastic solid rubber layer, which has been formed from heat resistant rubber, such as silicone rubber and fluorine rubber, can be used as the elastic layer 22. Alternatively, an elastic sponge rubber layer can be used, which has been formed by foaming the silicone rubber so as to have a more heat resistant effect. Alternatively, an elastic air bubble rubber layer can be used in which hollow fillers (micro balloon or the like) are dispersed in the silicone rubber layer, and gas portions are formed in a cured substance, and the heat resistant effect is enhanced. A releasing layer 23, such as the tetrafluoroethylene / perfluoroalkyl-vinyl-ether copolymer resin (PFA) and a polytetrafluoroethylene resin (PTFE), is formed on the outer peripheral face of the elastic layer 22.

In the present embodiment, an insulating silicone rubber, having the micro balloons dispersed therein, is used as the elastic layer 22 of the pressure roller 20, and a PFA tube, having a thickness of 50 μm, is used as the releasing layer 23. In the present embodiment, the length of the elastic layer 22 is determined to be the length of the pressure roller 20.

The pressure roller 20 is arranged so that the surface of the pressure roller 20 opposes the surface of the fixing film 13 in the lower part of the fixing film 13, and at the arranged position, the shaft portions 21a in both ends in the longitudinal direction of the metal core 21 are rotatably supported by the frame member 30 of the fixing apparatus 3 through bearings (not-shown).

(2-3) Pressure Mechanism

As is illustrated in FIG. 3A, both ends in the longitudinal direction of the metal stay 14, which reinforces the heat insulation holder 12, are pressurized toward the heat insulation holder 12 by pressure springs 19*a* and 19*b*, and thereby the heater 11 is pressurized to the pressure roller 20 through the fixing film 13. The elastic layer 22 is elastically deformed in a region in which the heater 11 is pressurized onto the pressure roller 20 through the fixing film 13, and thereby the fixing nip portion (nip portion) $N_s$ having a predetermined width, is formed by the surface of the pressure roller 20 and the surface of the fixing film 13 (see FIG. 2). In other words, the pressure roller 20 forms the fixing nip portion N with the heater 11 through the fixing film 13. That is, the nip portion forming unit comes into contact with the inner face of the fixing film 13, and forms the nip portion which sandwiches and conveys the recording material P together with the pressure roller 20. Incidentally, the heater 11, the heat insulation holder 12 and the metal stay 14 are components which are longer than the fixing film 13, in the generatrix direction of the fixing film 13.

(2-4) Heating and Fixing Operation

The rotation of an output axis of a drive motor (not-shown), which is rotationally driven according to a command to print,. is transmitted to a drive gear (not-shown) provided in an end in the longitudinal direction of the metal core 21 of the pressure roller 20, through a predetermined speed reduction mechanism (not-shown). As a result, the pressure roller 20 rotates in an arrow direction at a predetermined peripheral velocity (process speed). The rotation of the pressure roller 20 is transmitted to the surface of the fixing film 13 by a frictional force, which works between the surface of the pressure roller 20 and the surface of the fixing film 13, through the fixing nip portion N. As a result, the fixing film 13 follows the rotation of the pressure roller 20 while the inner face of the fixing film 13 comes into contact with the surface of the protection layer 11*c* of the heater 11, and rotates in the arrow direction.

A lubricant, like a heat resistant grease such as a fluorine-based grease and a silicone-based grease, intervenes between the inner face of the fixing film 13 and the surface of the protection layer 11*c* of the heater 11. As a result, frictional resistance between the inner face of the fixing film 13 and the surface of the protection layer 11*c* of the heater 11 is reduced to become low, and a smooth rotation of the fixing film 13 is secured.

In addition, an energization control circuit (not-shown) of an energization control unit energizes the current-energized resistance layer 11*b* of the heater 11 according to the command to print. As a result, the current-energized resistance layer 11*b* rapidly raises its temperature, and the heater 11 heats the fixing film 13. The temperature of the heater 11 is detected by a temperature detecting element 17 (see FIG. 2), such as a thermistor, provided on the rear surface of the substrate 11*a* in an opposite side to the fixing nip portion N. The energization control circuit captures a signal output from the temperature detecting element 17, determines a duty ratio, a frequency and the like of a voltage to be applied to the current-energized resistance layer 11*b* based on the signal, and keeps the temperature of the fixing nip portion N to a predetermined set temperature for fixing (target temperature).

In a state in which the drive motor is rotationally driven and the current-energized resistance layer 11*b* of the heater 11 is energized, and the temperature of the fixing nip portion N is kept at the predetermined set temperature for fixing, the recording material P having an unfixed toner image t carried thereon is introduced into the fixing nip portion N so that the surface having the unfixed toner image carried thereon faces upward. The recording material P is sandwiched by the surface of the fixing film 13 and the surface of the pressure roller 20 in the fixing nip portion N, and is conveyed therethrough. In the conveyance process, the unfixed toner image t on the recording material P is heated by the heater 11 through the fixing film 13 and is melted. At the same time, the unfixed toner image t receives a nip pressure of the fixing nip portion N, and is heated and fixed onto the recording material P. The recording material P on which the unfixed toner image t has been heated and fixed is separated from the surface of the fixing film 13, and is discharged from the fixing nip portion N.

(2-5) Shift Regulation Portions 12*a* and 12*b* of Heat Insulation Holder 12

As is illustrated in FIG. 3A, a shift regulation portion (regulation portion) 12*a* having a regulation face 12*a*1 for regulating a shift (movement) of the fixing film 13 to the longitudinal direction is provided in one end in the longitudinal direction of the heat insulation holder 12. The shift regulation portion 12*a* is arranged so that the regulation face 12*a*1 opposes the end face in the one end in the longitudinal direction of the fixing film 13, at a predetermined gap ga. In addition, as is illustrated in FIG. 3B, a shift regulation portion 12*b* is provided on the ends in the upstream side of the recording-material-conveyance direction and the downstream side of the recording-material-conveyance direction, in the transverse direction of the heat insulation holder 12. In addition, FIG. 3C illustrates a perspective view of the heat insulation holder 12 with which the shift regulation portion 12*b* has been integrally molded.

The shift regulation portion (regulation portion) 12*b* having a regulation face 12*b*1 for regulating the shift (movement) of the fixing film 13 to the longitudinal direction is provided in the other end in the longitudinal direction of the heat insulation holder 12. The shift regulation portion 12*b* is arranged so that the regulation face 12*b*1 opposes the end face in the other end in the longitudinal direction of the fixing film 13, at a predetermined gap gb. In addition, as is illustrated in FIG. 3B, the shift regulation portion 12*b* is provided on the ends in the upstream side of the recording-material-conveyance direction and the downstream side of the recording-material-conveyance direction, in the transverse direction of the heat insulation holder 12.

Both of the above-described two shift regulation portions 12*a* and 12*b* are molded integrally with the heat insulation holder 12 according to a molding method such as an injection molding method, and have such a shape as to be symmetrical with respect to the center c in the longitudinal direction of the fixing apparatus 3. Thus, one of the regulation portions 12*a* and 12*b* each is provided at a position which opposes one end face of the fixing film 13 and at a position which opposes the other end face thereof, and the two regulation portions 12*a* and 12*b* are both molded integrally with a component having a longer length than that of the fixing film 13.

The metal stay 14 is a member having a longer length than that of the fixing film 13. Both ends in the longitudinal direction of the metal stay 14 are extended to the outside of the shift regulation portions 12*a* and 12*b*, and receive a pressurization force of the pressure spring 19*a* and 19*b*, in spring receiving portions 14*a* and 14*b* provided on the ends in the outer side than the shift regulation portions 12*a* and 12*b*.

The positional relationship between the shift regulation portions 12*a* and 12*b*, and the end face in the longitudinal direction of the fixing film 13 (hereinafter referred to as end face of fixing film 13) will be described below with reference to FIG. 3B. As is illustrated in FIG. 3B, the outline of the end face of the fixing film 13 when the fixing film 13 is not rotated is approximately equal to the trajectory of the fixing film 13 (see FIG. 2) when the fixing film 13 is rotated.

When the recording material p is sandwiched by the fixing nip portion N and is conveyed therethrough, or follows the pressure roller 20 and is rotated, the fixing film 13 occasionally receives such a shift force as to move the fixing film 13 to one end side or the other end side in the longitudinal direction of the fixing film 13. In order to regulate the movement of the fixing film 13 by the shift regulation portions 12*a* and 12*b*, the shift regulation portions 12*a* and 12*b* need to project to the outer side than the trajectory of the fixing film 13, in a diameter direction of the fixing film 13. This is necessary in order that when the fixing film 13 has moved to the one end side or the other end side in the longitudinal direction thereof, the shift regulation portion 12 and 12*b* regulates the movement of the fixing film 13 by bringing the end face of the fixing film 13 into contact with the regulation faces 12*a*1 and 12*b*1.

On the other hand, when the shift regulation portion 12*a* and 12*b* is structured so that the whole region of the end face of the fixing film 13 can come into contact with the regulation faces 12*a*1 and 12*b* 1 for the end of the fixing film 13, the fixing film 13 cannot be inserted into the heat insulation holder 12 which supports the heater 11 and the metal stay 14, when the fixing assembly 10 is assembled.

Then, the heat insulation holder 12 needs to have a dimension so as to be insertable into the fixing film 13. For this reason, the fixing film 13 is structured so that a part of the trajectory of the end face of the fixing film 13 comes into contact with the shift regulation portions 12*a* and 12*b* in a state in which the fixing film 13 rotates.

Figure 4A:
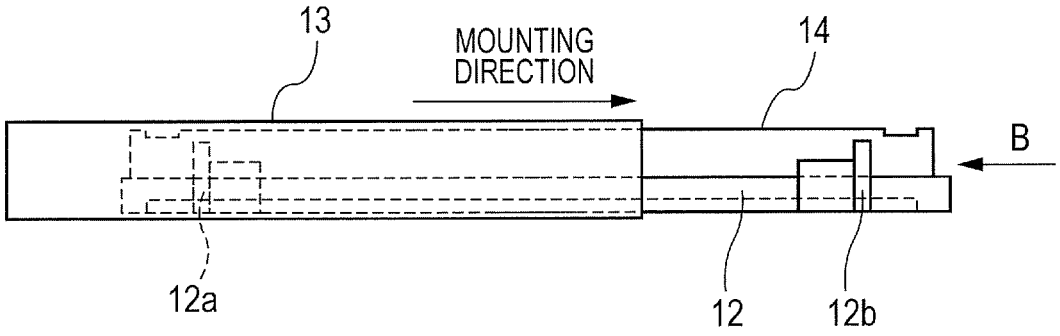
FIG. 4A is a front view illustrating a state in which a fixing film is inserted into the heat insulation holder that supports a heater and a metal stay.
Figure 4B:
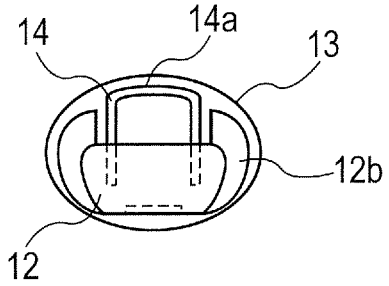
FIG. 4B is a side view illustrating the heat insulation holder which supports the heater and the metal stay, and the fixing film, in FIG. 4A, when viewed from the direction of the arrow B.

A method for mounting the fixing film 13 on the heat insulation holder 12, which supports the heater 11 and the metal stay 14, will be described below with reference to FIGS. 4A and 4B. FIG. 4A is a front view illustrating a state in which the fixing film 13 is mounted on the heat insulation holder 12 that supports the heater 11 and the metal stay 14. FIG. 4B is a side view illustrating the heat insulation holder 12, which supports the heater 11 and the metal stay 14, and the fixing film 13, in FIG. 4A, when viewed from the direction of the arrow B.

As is clear from FIG. 4B, the fixing film 13 is in a state in which the fixing film 13 does not come into contact with the pressure roller 20, when the fixing assembly 10 is assembled. Because of this, the fixing film 13 can be deflected to an ellipse shape more largely than a shape when the fixing film 13 comes into contact with the pressure roller 20, as illustrated in FIGS. 3A to 3C. The fixing film 13 can be mounted on the heat insulation holder 12, which supports the heater 11 and the metal stay 14, in a state in which the end face of the fixing film 13 has been largely deflected to the ellipse shape.

In other words, the end face of the fixing film 13 is largely deflected to the ellipse shape, and thereby the interference can be avoided which occurs between the end face of the fixing film 13, and the shift regulation portions 12*a* and 12*b* of the heat insulation holder 12 and a ceiling portion 14*a* of the metal stay 14. In other words, if the shift regulation portions 12*a* and 12*b* have fitted in the inner side than the outline of the fixing film 13 when the fixing film 13 is deflected to the ellipse shape, the fixing film 13 can be inserted into the heat insulation holder 12 which supports the heater 11 and the metal stay 14. As a result, the fixing assembly 10 can be simply assembled.

When the above description is considered, the shift regulation portions 12*a* and 12*b* need to project to the outer side in a diameter direction of the fixing film 13 than the trajectory of the end face of the fixing film 13 in a state in which the fixing film 13 is pressurized by the pressure roller 20. In addition, the projection amounts of the shift regulation portions 12*a* and 12*b* need to be suppressed to such a dimension that the shift regulation portions 12*a* and 12*b* do not interfere with the end face of the fixing film 13, when the fixing film 13 is deflected to the ellipse shape and is mounted on the heat insulation holder 12 that supports the heater 11 and the metal stay 14.

In the present embodiment, the regulation faces 12*a*1 and 12*b*1 of the shift regulation portions 12*a* and 12*b* are set so as to have such a shape as to satisfy the above-described two conditions. Specifically, the regulation faces 12*a*1 and 12*b*1 have been set at such a shape as to fit in an inner side than a cross-sectional shape of the fixing film 13 when the fixing film 13 has been deflected to a diameter direction in a state in which the fixing film 13 does not come into contact with the pressure roller 20, and as to project to the outer side than the trajectory of the fixing film 13 during rotation in a state in which the fixing film 13 comes into contact with the pressure roller 20 (in other words, in a state in which the fixing nip portion N is formed).

Thus, the regulation portion 12*a* and the regulation portion 12*b* have such a size as to be insertable into the inner volume (e.g. cylinder) surrounded by the fixing film 13. In addition, the regulation portion 12*a* and the regulation portion 12*b* have such portions as to project to the outer side in a radial direction of the fixing film 13 than the outline of the end face of the fixing film 13 when the fixing apparatus 3 is used, and thereby can regulate the shift movement of the fixing film 13.

Figure 5A:
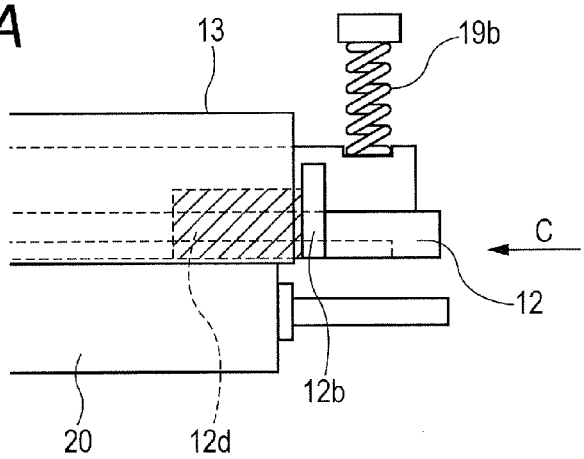
FIG. 5A is a front view of one side in a longitudinal direction of the fixing film and a pressure roller.
Figure 5B:
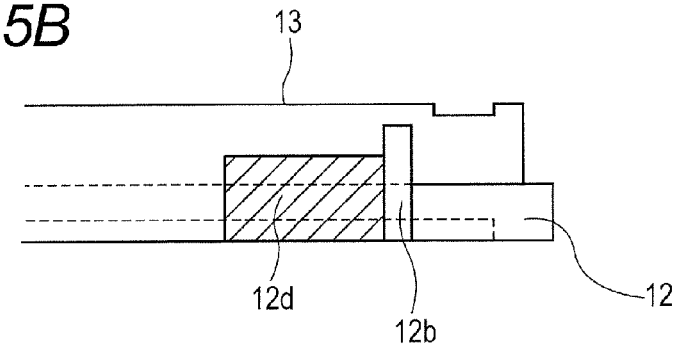
FIG. 5B is an explanatory drawing of a guide portion provided at one side in a longitudinal direction of the heat insulation holder.

Next, guide portions 12*c* and 12*d* provided on the heat insulation holder 12 will be described below with reference to FIGS. 5A to 5C. FIG. 5A is a front view of one side in a longitudinal direction of the fixing film 13 and the pressure roller 20, FIG. 5B is an explanatory drawing of the guide portion 12*d* provided in one side in a longitudinal direction of the heat insulation holder 12, and FIG. 5C is an enlarged side view of the fixing film 13 and the pressure roller 20 of FIG. 5A when viewed from the direction of the arrow C.

As is illustrated in FIG. 3A, guide portions 12*c* and 12*d* for guiding the trajectory of the fixing film 13 during rotation are provided in the inner side of the shift regulation portions 12*a* and 12*b* in the longitudinal direction of the heat insulation holder 12. The guide portions 12*c* and 12*d* are molded integrally with the heat insulation holder 12, according to a molding method, such as an injection molding method. The guide portions 12*c* and 12*d* are also arranged so as to be symmetrical with respect to the center c in the longitudinal direction of the fixing apparatus 3.

Figure 5C:
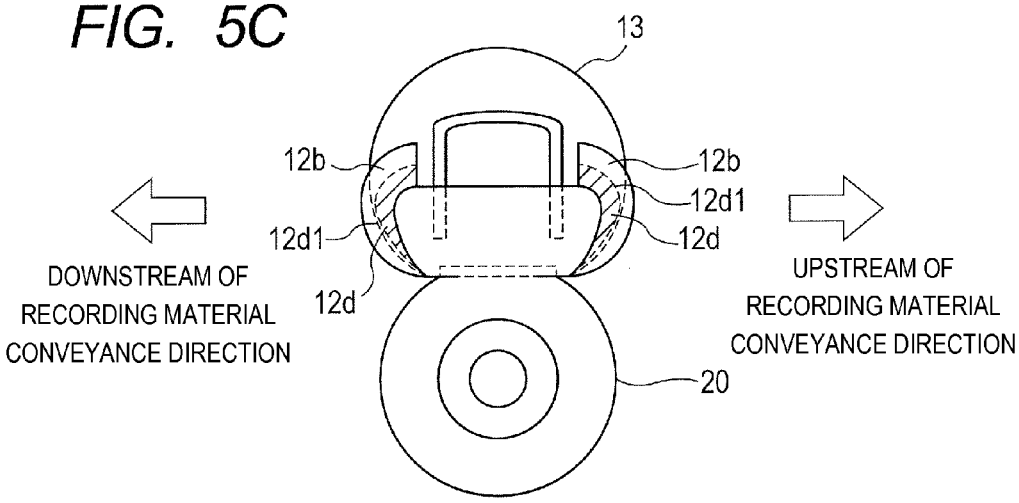
FIG. 5C is an enlarged side view of the fixing film and the pressure roller of FIG. 5A when viewed from the direction of the arrow C.

The guide portion 12*c* provided in one end in the longitudinal direction of the heat insulation holder 12 out of the guide portions 12*c* and 12*d* is provided on the ends in the upper-stream side of the recording-material-conveyance direction and the downstream side of the recording-material-conveyance direction, in the transverse direction of the heat insulation holder 12 (see FIG. 5C). On the other hand, the guide portion 12*d* provided in the other end in the longitudinal direction of the heat insulation holder 12 is provided on the ends in the upper-stream side of the recording-material-conveyance direction and the downstream side of the recording-material-conveyance direction, in the transverse direction of the heat insulation holder 12 (see FIG. 5C).

The respective outside surfaces in the transverse direction of the heat insulation holder 12 of the guide portions 12*c* and 12*d* are formed so as to be arcuate surfaces 12*d*1 and 12*d*1 which have approximately the same curvature as the curvature of the fixing film 13 in a state in which the fixing nip portion N is formed. The arcuate surfaces 12*d*1 and 12*d*1 are structured so as to guide the trajectory of the fixing film 13 during rotation by making the inner face of the fixing film 13 slide on the arcuate surfaces 12*d*1 and 12*d*1. Because the fixing apparatus 3 has the guide portions 12*c* and 12*d*, the trajectory of the fixing film 13 during rotation is stabilized. Accordingly, even when the fixing film 13 has received a shift force, the trajectory of the fixing film 13 is not disordered, and can maintain a state in which the fixing film 13 stably comes into contact with the regulation portions 12*a* and 12*b*.

(3) Examples of Comparative Experiment

Based on the structure of the above-described fixing apparatus 3 of the present embodiment, the following comparative experiments were carried out with the use of a fixing apparatus of an embodiment and a fixing apparatus of a comparative example, which would be described below.

Embodiment 1-1

The fixing apparatus of Embodiment 1-1 has the same structure as that of the fixing apparatus 3 in the present embodiment, except that a heat insulation holder, which integrally has only shift regulation portions 12*a* and 12*b* in the outside of both ends in the longitudinal direction of the fixing film 13, as is illustrated in FIGS. 3A to 3C, is used as the heat insulation holder 12. The material of the heat insulation holder 12 is a liquid crystal polymer, and the shift regulation portions 12*a* and 12*b* are also molded of the same material as that of the heat insulation holder 12.

Embodiment 1-2

The fixing apparatus of Embodiment 1-2 has the same structure as that of the fixing apparatus 3 in the present embodiment, except that a heat insulation holder, which has guide portions 12*c* and 12*d* for guiding the trajectory of the fixing film 13 during rotation in the inner side of the shift regulation portions 12*a* and 12*b*, as is illustrated in FIGS. 5A to 5C, is used as the heat insulation holder 12. These guide portions 12*c* and 12*d* are also molded integrally with the heat insulation holder 12 and the shift regulation portions 12*a* and 12*b*. The material of the heat insulation holder 12 is a liquid crystal polymer, similarly to that in Embodiment 1-1.

Comparative Example

Figure 6:
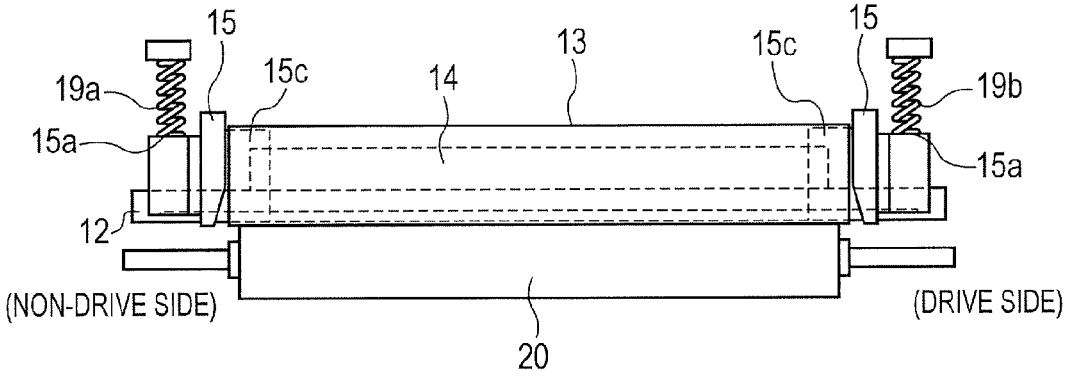
FIG. 6 is a front view illustrating a schematic structure of a fixing apparatus of a comparative example when viewed from the recording material introduction side.

The fixing apparatus of a comparative example has the same structure as that of the fixing apparatus 3 in the present embodiment, except that the fixing apparatus has a shift regulation flange 15, which is provided in both ends in the longitudinal direction of the fixing film 13 separately from the heat insulation holder 12, as is illustrated in FIG. 6. As for the shift regulation flange 15, a fitting portion (not-shown) provided in the shift regulation flange 15 is fitted at least in one end of any of a fixing frame and the heat insulation holder 12 or the metal stay 14. The regulation flange 15 has a guide portion 15*c* provided therein, which guides the trajectory of the fixing film 13 during rotation.

In addition, the fixing apparatus of the comparative example has a spring receiving portion 15*a*, which receives a pressure force from a pressure spring 19*a* and 19*b*, as is illustrated in FIG. 6. The pressure force from the pressure spring 19*a* and 19*b* is applied to the metal stay 14 through the corresponding regulation flange 15, and thereby the whole metal stay 14 presses the heat insulation holder 12 to the inner face side of the fixing film 13 over the longitudinal direction. The material of the regulation flange 15 is a liquid crystal polymer, similarly to that in Embodiment 1-1 and Embodiment 1-2.

Comparative Experiment 1

The following experiment was carried out in order to compare effects of fixing apparatuses of Embodiment 1-1, Embodiment 1-2 and the comparative example.

In each of the fixing apparatuses, the pressure force of the pressure spring 19*a* and 19*b*, which is arranged in the both ends in the longitudinal direction of the metal stay 14 is set intentionally so as to become unbalanced. Specifically, the pressure force is set so that an approximately constant shift force is generated at a drive side (drive gear side) of the pressure roller 20 of the fixing film 13. Here, a pressure force of 117.6N (12 kgf) is applied to a non-drive side (opposite side to drive gear) of the pressure roller 20, and a pressure force of 78.4 N (8 kgf) is applied to the drive side of the pressure roller 20. The pressure force of the pressure spring 19*a*and 19*b* was set in this way, and thereby was adjusted so as to generate a shift force of approximately 6.37 N (650 gf) in the drive side direction of the pressure roller 20 of the fixing film 13 when the fixing apparatus was operated.

Figure 7:
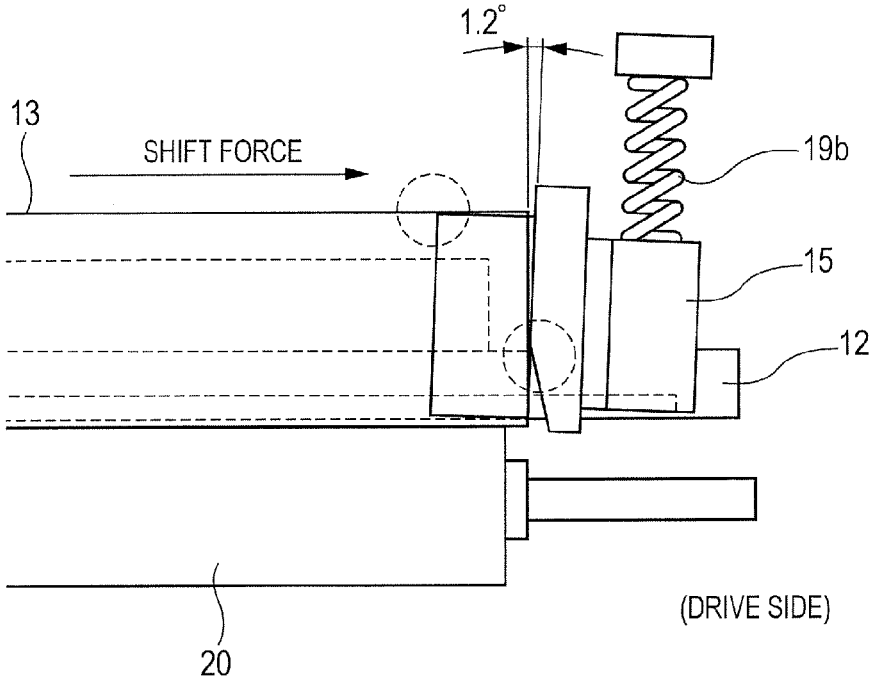
FIG. 7 is an explanatory drawing for illustrating Comparative Experiment 1 for the fixing apparatus of the comparative example.

In addition, in the fixing apparatus of the comparative example, the regulation flange 15 is set in a state in which the regulation flange 15 tilts to the outside in the longitudinal direction by 1.2 degrees, as is illustrated in FIG. 7. This is a tilt that is generated by the pressure force that the regulation flange 15 receives from the pressure spring 19*a* and 19*b*and is a tilt that can be generated when a clearance and the like are considered at the maximum, which occur within a production range because there is a component tolerance in a fitting portion of the heat insulation holder 12 and the metal stay 14. The fixing apparatus is set so that the regulation flange 15 and the fixing film 13 are locally brought into contact with each other in circular portions surrounded by dot lines in the figure, and so that stresses are applied to the fixing film 13.

On the other hand, in the fixing apparatuses of Embodiment 1-1 and Embodiment 1-2, the shift regulation portions 12*a* and 12*b* are molded integrally with the heat insulation holder 12, and accordingly a tilt as in the regulation flange 15 of the fixing apparatus of the comparative example does not occur.

In this state, a sheet-feeding durability test was carried out, and the presence or absence of damage and a wear of the end face of the fixing film 13 was confirmed. Plain paper having a basis weight of 75 g/m$^2$ was used as the paper for the sheet-feeding durability test. The result is shown in Table 1. Table 1 shows a result obtained by having observed a state of the fixing film 13 for every fixed number of sheets. When damage and the wear were not observed on the end face of the fixing film 13 and its periphery, after 50,000 sheets, 100,000 sheets, 150,000 sheets, 200,000 sheets and 250,000 sheets of paper were fed, the result was evaluated to be good. In addition, when damage and the wear were clearly confirmed, and paper could not be fed any more, the result was evaluated to be poor. When slight wear is observed, but sheet-feeding can be continued, the result is denoted so as to be fair.

Comparative Experiment 2

In addition, as for Comparative Experiment 2, in each of the fixing apparatuses, the pressure force of the pressure spring 19*a* and 19*b* was adjusted so as to generate a shift force of approximately 6.37 N (650 gf) in a drive side direction of the pressure roller 20 of the fixing film 13, by a similar setting to the above-described setting.

Figure 8:
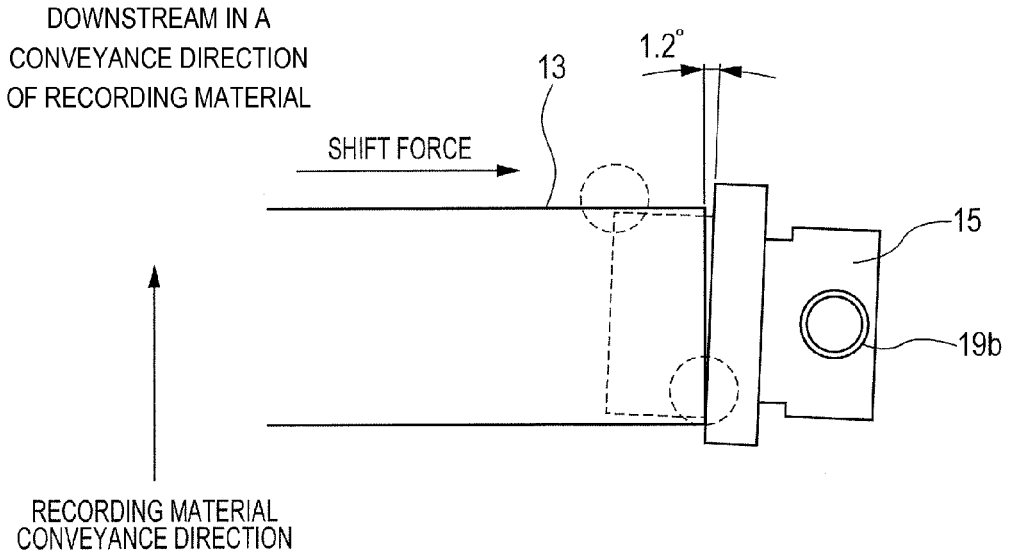
FIG. 8 is an explanatory drawing for illustrating Comparative Experiment 2 for the fixing apparatus of the comparative example.

In addition, in the fixing apparatus of the comparative example, the regulation flange 15 is set in a state in which the regulation flange 15 tilts to the downstream side in the sheet-feeding direction by 1.2 degrees, as is illustrated in FIG. 8. The tilt of the regulation flange 15 can be generated in the following way. Specifically, when the fixing film 13 follows the rotation of the pressure roller 20 and is rotated, such a force as to move the heater 11 and the heat insulation holder 12 to the downstream side of the recording-material-conveyance direction acts on the heater 11 and the heat insulation holder 12, due to a frictional force with the inner face of the fixing film 13. The heat insulation holder 12 and the regulation flange 15 are fitted to each other, and accordingly, such a force acts also on the regulation flange 15 that the regulation flange 15 also tends to move to the downstream side of the recording-material-conveyance direction. However, the regulation flange 15 is fitted in the pressure spring 19 and the fixing frame, and accordingly does not move. Because of this, the spring receiving portion 15*a* (in position of spring 19*b* in FIG. 8) functions as a supporting point, and the regulation flange 15 tilts as in FIG. 8.

When there is the clearance due to a component tolerance or the like, it is considered that the regulation flange 15 tilts due to a rotary power toward the above-described downstream side of the recording-material -conveyance direction. The above-described tilt of 1.2 degrees is a tilt which can be generated when the component tolerance, the clearance and the like are considered at the maximum, which occur in production. The fixing apparatus is set so that the regulation flange 15 and the fixing film 13 are locally brought into contact with each other in circular portions surrounded by dot lines in FIG. 8, and so that stresses are applied to the fixing film 13.

On the other hand, in the fixing apparatuses of Embodiment 1-1 and Embodiment 1-2, the shift regulation portions 12*a* and 12*b* are molded integrally with the heat insulation holder 12, and accordingly a tilt as in the regulation flange 15 of the fixing apparatus of the comparative example does not occur.

In this state, the sheet-feeding durability test was carried out in a similar way to that in Comparative Experiment 1. The result is shown in Table 2. The state of the fixing film 13 in the durability test is similar to that in the description of the above-described Comparative Experiment 1.

TABLE 1

Result of Comparative Experiment 1

| | 50,000 sheets | 100,000 sheets | 150,000 sheets | 200,000 sheets | 250,000 sheets |
|---|---|---|---|---|---|
| Embodiment 1-1 | Good | Good | Good | Good | Fair |
| Embodiment 1-2 | Good | Good | Good | Good | Good |
| Comparative Example | Good | Poor | — | — | — |

TABLE 2

Result of Comparative Experiment 2

| | 50,000 sheets | 100,000 sheets | 150,000 sheets | 200,000 sheets | 250,000 sheets |
|---|---|---|---|---|---|
| Embodiment 1-1 | Good | Good | Good | Good | Fair |
| Embodiment 1-2 | Good | Good | Good | Good | Good |
| Comparative Example | Good | Fair | Poor | | |

As is clear from the above-described results of Tables 1 and 2, in the fixing apparatus of the comparative example, damage of the end of the fixing film 13 and the wear of the inner face of the fixing film 13 occur as a result of sheet-feeding of the order of 100,000 to 150,000 sheets. In contrast to this, in the fixing apparatuses of Embodiment 1-1 and Embodiment 1-2, wear and damage of the fixing film 13 have not occurred even when 250,000 sheets have been fed, from which it can be understood that an adequate state has been maintained. This is because in the fixing apparatus of the comparative example, a large stress continues to be applied onto the sliding portion of the fixing film 13 and the regulation flange 15, as is illustrated in the circular portions surrounded by the dot lines in FIGS. 7 and 8.

On the other hand, when the shift regulation portions 12*a* and 12*b* are molded integrally with the heat insulation holder 12 as in the fixing apparatus 3 of the present embodiment, a tilt as in the regulation flange 15 does not occur in the shift regulation portions 12*a* and 12*b*. Because of this, the stress received by the fixing film 13 is reduced, and damage received by the fixing film 13 through the durability test can be reduced.

As described above, the fixing apparatus 3 of the present embodiment can regulate the movement of the fixing film 13 in the longitudinal direction by the shift regulation portions 12*a* and 12*b*, which are provided on the heat insulation holder 12 that supports the heater 11. As a result, the stress can be reduced which causes damage of the end in the longitudinal direction and wear of the fixing film 13.

Embodiment 2

Figure 9A:
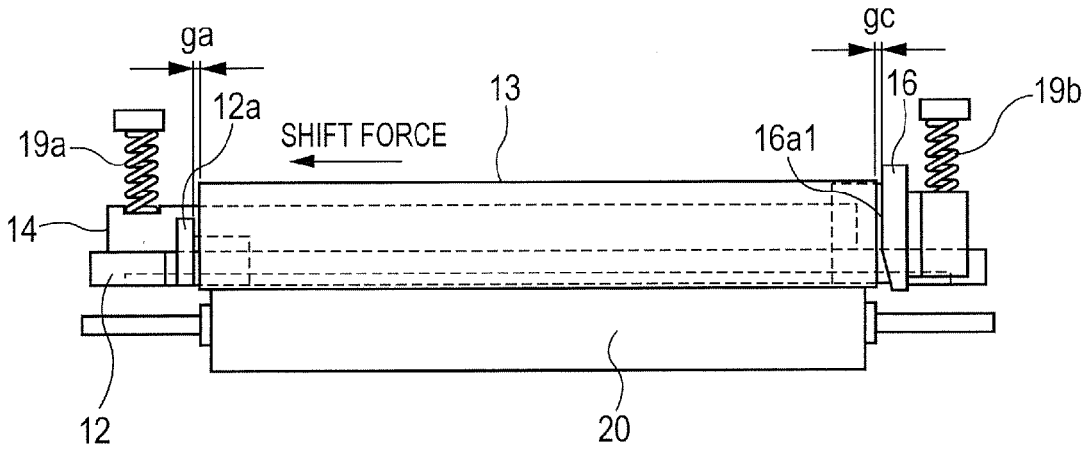
FIG. 9A is a front view of the fixing apparatus according to Embodiment 2 when viewed from the recording-material-introduction side.
Figure 9B:
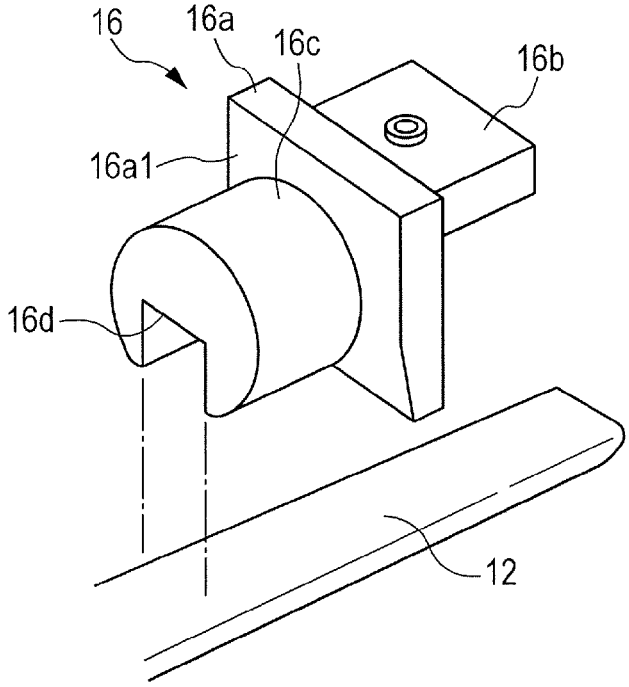
FIG. 9B is an explanatory drawing of a shift regulation flange incorporated in the heat insulation holder of the fixing apparatus.

Another embodiment of a fixing apparatus 3 will be described below. FIG. 9A is a front view of the fixing apparatus 3 according to the present embodiment when viewed from the recording material introduction side. FIG. 9B is an explanatory drawing of a shift regulation flange 16 incorporated in the heat insulation holder 12 of the fixing apparatus 3.

The fixing apparatus 3 illustrated in the present embodiment includes a shift regulation portion that has been molded integrally with the heat insulation holder 12, in any one end out of one end and the other end in the longitudinal direction of the heat insulation holder 12. Specifically, any one shift regulation portion out of the shift regulation portions in the one end and in the other end in the longitudinal direction of the heat insulation holder 12 is molded integrally with the heat insulation holder 12, and the other shift regulation portion is molded separately from the heat insulation holder 12. Thus, in the fixing apparatus in the present embodiment, one of the regulation portions each is provided at a position that opposes one end face of the fixing film and at a position which opposes the other end face thereof, and only one regulation portion is molded integrally with a component having a longer length than that of the fixing film. In addition, the regulation portion 16, which opposes the other end face of the fixing film, has such a size as to not be insertable into the cylinder of the fixing film.

The fixing apparatus 3 of the present embodiment is structured so as to have the shift regulation flange 16 as a shift regulation portion which has been molded separately from the heat insulation holder 12, on the other end of the heat insulation holder 12 in the opposite side to the shift regulation portion 12*a*, which has been molded integrally with the heat insulation holder 12, as illustrated in FIGS. 9A and 9B.

The shift regulation flange 16 has the same structure as that of the regulation flange 15, which has been described in Embodiment 1, and has a substrate 16*a* which opposes the end face in the other end in the longitudinal direction of the fixing film 13. In the substrate 16*a*, the face in the fixing film 13 side is formed to be a regulation face 16*a*1 which regulates a shift(movement) of the fixing film 13 to the longitudinal direction. On the regulation face 16*a*1 in the end of the fixing film 13, a guide portion 16*c* for guiding the trajectory of the fixing film 13 during rotation is formed so as to project toward the fixing film 13. Furthermore, the spring receiving portion 16*b* for the pressure spring 19*a* and 19*b* is formed in the opposite side to the guide portion 16*c* of the substrate 16*a*.

As for the shift regulation flange 16, the spring receiving portion 16*b* is supported by the fixing frame, and simultaneously a groove portion 16*d* provided in the bottom part of the substrate 16*a* and the guide portion 16*c* is fitted in the other end in the longitudinal direction of the heat insulation holder 12. Thus, the shift regulation flange 16 is structured so as to be incorporated in the heat insulation holder 12.

In the fixing apparatus 3 of Embodiment 1, the shift regulation portions 12*a* and 12*b* are molded integrally with the heat insulation holder 12 on both ends in the longitudinal direction of the heat insulation holder 12. Because of this, in an assembly operation of the fixing assembly 10, when the fixing film 13 is mounted on the heat insulation holder 12 which supports the heater 11 and the metal stay 14, it has been necessary to insert the heat insulation holder 12 while deflecting the end face of the fixing film 13 to the ellipse shape so that the fixing film 13 is not brought into contact with the shift regulation portion 12*a* and 12*b* (FIGS. 4A and 4B).

In the fixing apparatus 3 of the present embodiment, when the fixing assembly 10 is assembled, first, the fixing film 13 is mounted from the end side of the heat insulation holder 12 that supports the heater 11 and the metal stay 14, in which the shift regulation flange 16 is to be incorporated. The shift regulation flange 16 may be incorporated in the heat insulation holder 12 after the fixing film 13 has been mounted. In the shift regulation flange 16, which has been incorporated in the heat insulation holder 12, a regulation face 16*a*1 opposes the end face of the other end in the longitudinal direction of the fixing film 13 with a predetermined gap gc (see FIG. 9A).

The fixing apparatus 3 of the present embodiment does not need to deflect the end face of the fixing film to the ellipse shape when the fixing assembly 10 is assembled, as in the fixing apparatus 3 of Embodiment 1, and accordingly can enhance assembly properties of the fixing assembly 10. In addition, the regulation portion 16 is a different component from the heat insulation holder 12, and accordingly the flexibility of the size and the shape of the shift regulation portion 12*a* of the heat insulation holder 12 is enhanced.

Figure 10A:
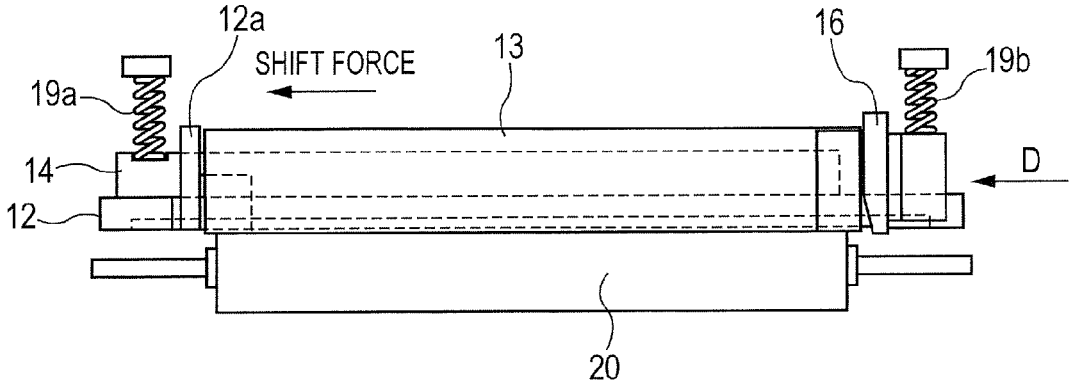
FIG. 10A is a front view of the fixing apparatus according to Embodiment 2 when viewed from the recording-material-introduction side, and is a view illustrating one example of the size of a shift regulation portion of the heat insulation holder.
Figure 10B:
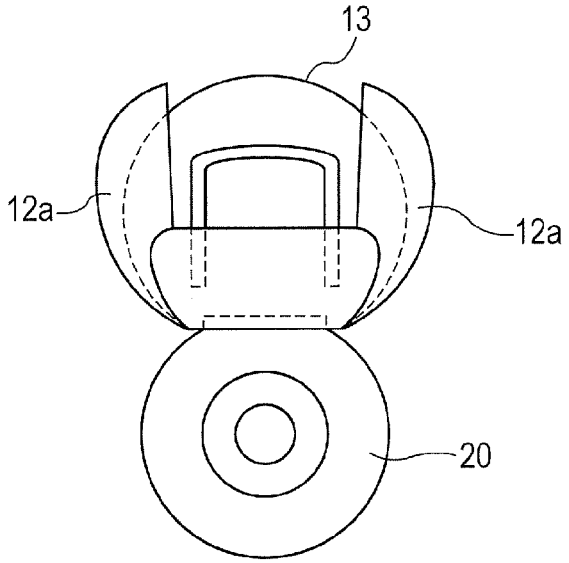
FIG. 10B is an enlarged side view of the fixing apparatus of FIG. 10A when viewed from the direction of the arrow D, and is a view illustrating one example of a shape of the shift regulation portion of the heat insulation holder.

The reason why the flexibility of the size and the shape of the shift regulation portion 12*a* of the heat insulation holder 12 can be enhanced will be described below. FIGS. 10A and 10B illustrate one example of the shift regulation portion 12a of the heat insulation holder 12. FIG. 10A is a front view of the fixing apparatus 3 according to the present embodiment when viewed from the recording-material-introduction side, and is a view illustrating one example of the size of the shift regulation portion 12*a* of the heat insulation holder 12. FIG. 10B is an enlarged side view of the fixing apparatus 3 of FIG. 10A when viewed from the direction of the arrow D, and is a view illustrating one example of a shape of the shift regulation portion 12*a* of the heat insulation holder 12.

For instance, the size of the shift regulation portion 12*a* of the heat insulation holder 12 can be expanded to the peripheral direction of the fixing film 13 more than that of the shift regulation portion 12*a* in Embodiment 1 illustrated in FIG. 3A (see FIGS. 10A and 10B). The shift regulation portion 12*a* illustrated in FIG. 10B has such a size as to not be insertable into the cylinder of the fixing film 13.

When the size and the shape of the regulation face 12*a*1 of the shift regulation portion 12*a* are expanded in this way, even if the shift force of the fixing film 13 to the shift regulation portion 12*a* has increased, for instance, a pressure given to the unit area of the end face of the fixing film 13 can be dispersed. Because of this, a local force tends to be easily reduced which causes damage in the end in the longitudinal direction of the fixing film 13.

Specifically, the stress can be reduced which causes damage of the end in the longitudinal direction and wear of the fixing film 13.

On the other hand, when the shift force of the fixing film 13 acts in a direction of the shift regulation flange 16 provided on the heat insulation holder 12, the movement of the shift regulation flange 16 may result in easily giving a-damage to the end face of the fixing film 13 due to the clearance and the tilt of the shift regulation flange 16, as in the above-described fixing apparatus of the comparative example. Accordingly, in the fixing apparatus 3 of the present embodiment, it is desirable to control the shift force of the fixing film 13 so as to act in a direction of the shift regulation portion 12*a* provided on the heat insulation holder 12.

Various methods are considered as methods for controlling the direction of the shift of the fixing film 13, but one example includes the following structure.

One is a method, for instance, of setting a pressure force of the pressure spring 19*a* and a pressure force of the pressure spring 19*b* so as to be unbalanced. As a result, the shift force of the fixing film 13 can be controlled so as to act in one direction in the longitudinal direction of the fixing film 13, in other words, only in the direction of the shift regulation portion 12*a* provided on the heat insulation holder 12. In this method, the pressure force is set so as to be unbalanced, and thereby, on the contrary, the shift force results in increasing. Accordingly, the pressure force needs to be controlled in such a range as not to cause damage on the end in the longitudinal direction of the fixing film 13.

Figure 11:
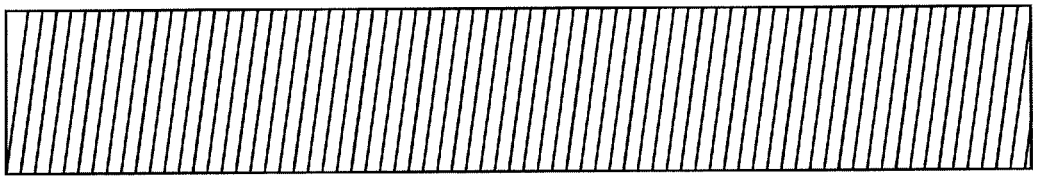
FIG. 11 is an explanatory drawing illustrating one example of spiral-shaped unevenness formed on the inner face of the fixing film, in the fixing apparatus according to Embodiment 2.

In addition, as another example, there is a method of forming spiral unevenness as in illustrated in FIG. 11 on the inner face of the used fixing film 13. As a result, the fixing apparatus can control the direction of the shift of the fixing film 13. Such a spiral unevenness can be easily obtained by being formed when the fixing film 13 is produced.

When the growth of a work (object to be worked) is promoted in a longitudinal direction while the work is rotated during the production of the fixing film 13, for instance, the spiral unevenness can be given to the fixing film 13 by the adjustment of the rotation speed and the feed per revolution in the longitudinal direction, and the like. Alternatively, the spiral unevenness may be given to the fixing film 13 by post processing or the like. This method causes an increase in the heat resistance on a contact face with the heater 11 as a space between the salients of the unevenness, which is formed on the inner face of the fixing film 13. Accordingly, the unevenness needs to be suppressed to such an extent as not to impair the thermal conduction performance. As another application example of this method, there is a method of giving an oblique uneven line onto a sliding face of the heater 11, on which the inner face of the fixing film 13 slides. A similar effect can be expected also by the method.

As another example for controlling the direction of the shift of the fixing film 13, there is a method of making the whole fixing assembly 10 cross an axial direction of the pressure roller 20. Furthermore, there is also a method of forming the end face in the longitudinal direction of the fixing film 13 or the pressure roller 20, into a tapered shape, and thereby providing a difference between left and right peripheral lengths of the fixing film 13 or the pressure roller 20. Furthermore, there is also a method of providing a projecting portion or the like, which comes into contact with the inner face of the fixing film 13, in a part of the heat insulation holder 12, and generating a shift force toward one direction of the longitudinal direction of the fixing film 13.

Here, the method for controlling the direction of the shift of the fixing film 13 is not limited to the above-described methods, and any method and structure may be adopted as long as the direction of the shift of the fixing film 13 can be controlled by balance with or adjustment by other members of the fixing apparatus.

Embodiment 3

Figure 12A:
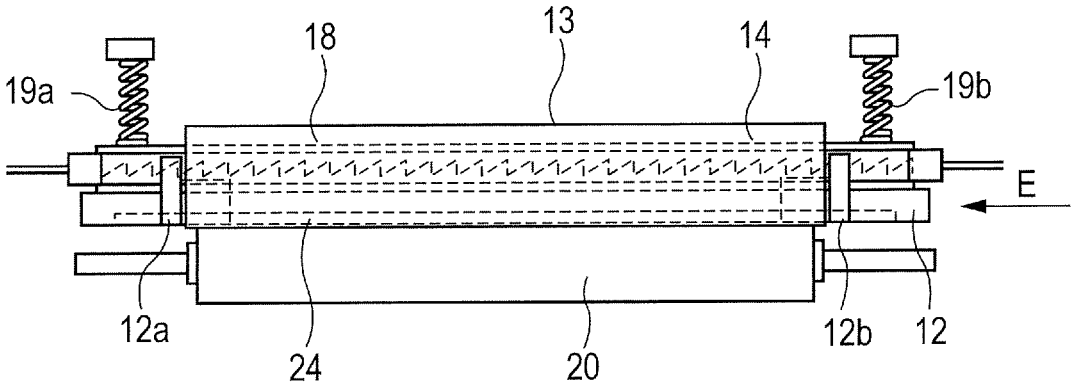
FIG. 12A is a front view of a fixing apparatus according to Embodiment 3 when viewed from the recording-material-introduction side.
Figure 12B:
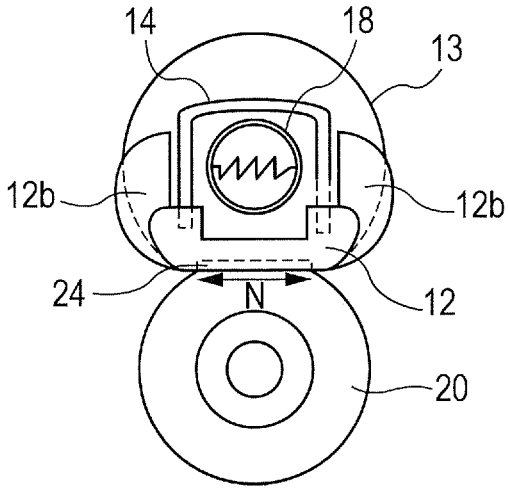
FIG. 12B is an enlarged side view of the fixing apparatus of FIG. 12A when viewed from the direction of the arrow E.
Figure 13:
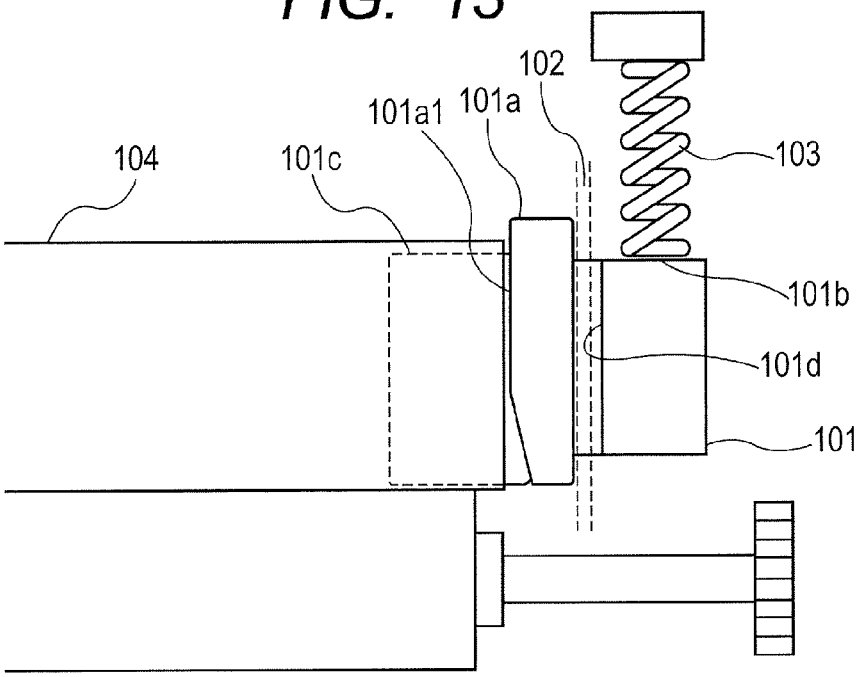
FIG. 13 is a view illustrating an assembled structure of a regulation flange in the fixing apparatus of the comparative example.
Figure 14:
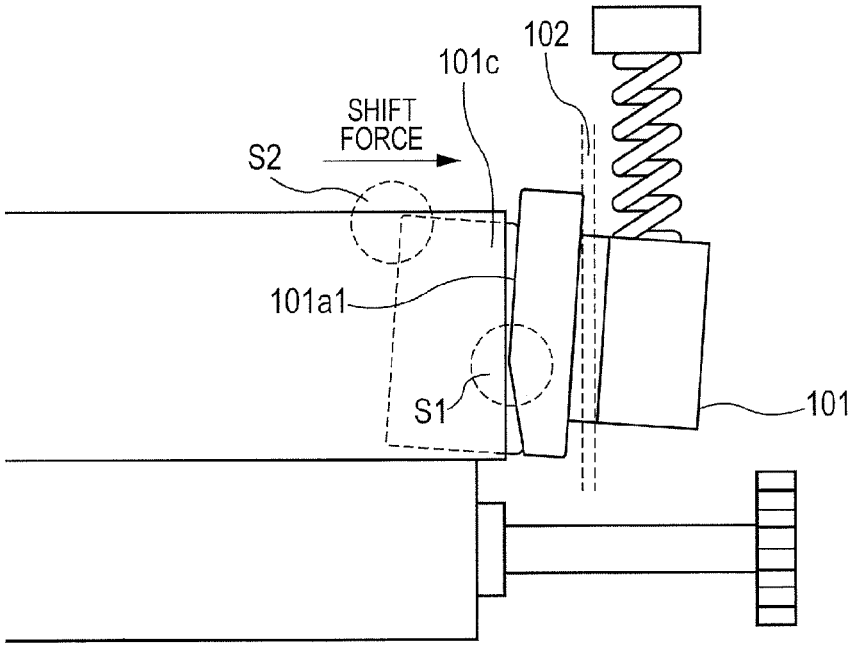
FIG. 14 is a view illustrating a state in which the whole regulation flange tilts, in the fixing apparatus of the comparative example.
Figure 15:
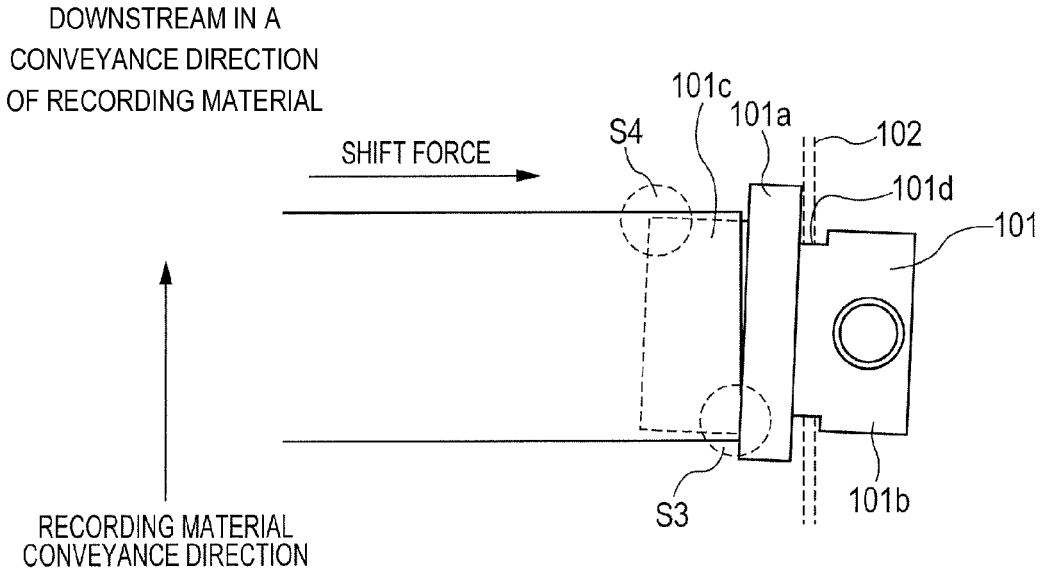
FIG. 15 is a view illustrating a state in which the whole regulation flange tilts toward the upstream side of the recording-material-conveyance direction, in the fixing apparatus of the comparative example.

Another example of the fixing apparatus 3 will be described below. FIG. 12A is a front view of the fixing apparatus 3 according to the present embodiment when viewed from the recording-material-introduction side, and FIG. 12B is an enlarged side view of the fixing apparatus 3 of FIG. 12A when viewed from the direction of the arrow E.

In the fixing apparatus 3 illustrated in the present embodiment, a halogen heater 18 is used as a heating element, and the halogen heater 18 is arranged between a heat insulation holder 12 and a metal stay 14. The halogen heater 18 is supported by the heat insulation holder 12 or the metal stay 14 through a bracket (not-shown), in both ends in the longitudinal direction. In addition, a pressure plate 24 of a pressure member is supported by the heat insulation holder 12 so as to oppose the pressure roller 20 through the fixing film 13.

Both ends in the longitudinal direction of the metal stay 14, which is supported by the heat insulation holder 12, are pressurized toward the heat insulation holder 12 by pressure springs 19*a* and 19*b*, and thereby the pressure plate 24 is pressurized to the pressure roller 20 through the fixing film 13. An elastic layer 22 in the pressure roller 20 is elastically deformed in a region in which the pressure plate 24 is pressurized to the pressure roller 20 through the fixing film 13, and thereby a fixing nip portion (nip portion) N having a predetermined width is formed by the surface of the pressure roller 20 and the surface of the fixing film 13. Specifically, the pressure roller 20 forms the fixing nip portion N with the pressure plate 24, through the fixing film 13.

In the fixing apparatus 3 of the present embodiment, it is desirable that the pressure plate 24 is a plate-shaped substrate with high thermal conductivity so as to efficiently transmit heat from the halogen heater 18 to the fixing film 13. A material of the pressure plate 24 may be a metal plate obtained by molding a metal material such as SUS, nickel, copper and aluminum solely or as an alloy thereof, a glass plate, or a heat resistant resin such as polyimide, other than a ceramic substrate of alumina, aluminum nitride or the like. In addition, in order to adequately maintain sliding properties with the inner face of the fixing film 13, the pressure plate 24 may have a sliding layer of polyimide, a fluorine resin, diamond-like carbon (DLC) or the like formed on the surface in the fixing film 13 side.

Furthermore, the pressure plate 24 has optimally a thickness of approximately 0.3 mm to 2.0 mm, in order to have a sufficient strength and also suppress heat capacity. In the present embodiment, the heat insulation holder 12 corresponds to a component which has a longer length than that of a fixing film 13.

Other members have similar functions to those of the fixing apparatuses in Embodiment 1 and Embodiment 2. In the fixing apparatus 3 of the present embodiment, the metal stay 14 may have a structure in which a part of the metal stay 14 is cut away so that radiant heat is transmitted directly onto the inner face of the fixing film, in order that the radiant heat from the halogen heater 18 is more efficiently transmitted to the fixing film 13. Similarly, when the part of the heat insulation holder 12 is cut away so that the radiant heat from the halogen heater 18 is transmitted directly onto the pressure plate 24, the fixing film 13 can be more effectively heated.

Also in the fixing apparatus 3 of the present embodiment, shift regulation portions 12*a* and 12*b* for regulating the shift of the fixing film 13 are provided on both ends of the heat insulation holder 12 in the longitudinal direction. These shift regulation portions 12*a* and 12*b* are molded integrally with the heat insulation holder 12. Because the shift regulation portions 12*a* and 12*b* are molded integrally with the heat insulation holder 12, an action effect similar to that of the fixing apparatus 3 in Embodiment 1 can be obtained.

Also in the fixing apparatus 3 of the present embodiment, only one regulation portion may be molded integrally with the heat insulation holder 12, in a similar way to that of the fixing apparatus 3 in Embodiment 2. As a result, an action effect similar to that of the fixing apparatus 3 in Embodiment 2 can be obtained.

Other Embodiment

The above-described image heating apparatus is not limited to uses as an apparatus which heats and fixes an unfixed toner image onto a recording material. The image heating apparatus can be also used, for instance, as an apparatus which temporarily fixes the unfixed toner image onto the recording material, or an apparatus which heats a toner image that has been already heated and fixed onto the recording material to impart glossiness to the surface of the toner image.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2012-089998, filed Apr. 11, 2012, which is hereby incorporated by reference herein in its entirety.

What is claimed is:

1. An image heating apparatus for heating an image formed on a recording material, comprising:

an endless belt;

a roller which contacts an outer face of the belt;

a nip portion forming unit which contacts an inner face of the belt, and forms a nip portion with the roller, configured to nip and convey a recording material, the nip portion forming unit including a component which is longer than the belt in a generatrix direction of the belt; and a regulation portion provided to oppose an end face of the belt, configured to regulate a shift movement of the belt to the generatrix direction of the belt, wherein the regulation portion is integrally-molded with the component.

2. An image heating apparatus according to claim 1, further comprising another regulation portion provided to oppose another end face of the belt, and the regulation portion and the another regulation portion are both integrally molded with the component.

3. An image heating apparatus according to claim 1, further comprising another regulation portion provided to oppose another end face of the belt, and the another regulation portion is not integrally molded with the component.

4. An image heating apparatus according to claim 3, wherein the regulation portion opposing the end face of the belt is of a size so that the regulation portion is not insertable into a cylinder of the belt.

5. An image heating apparatus according to claim 3, wherein the another regulation portion which opposes the another end face of the belt is of a size so that the another regulation portion is not insertable into a cylinder of the belt.

6. An image heating apparatus according to claim 1, wherein the regulation portion is of a size so that the regulation portion is insertable into a cylinder of the belt, and wherein the regulation portion includes a portion that projects from an outline of the end face of the belt in a radial direction of the belt to regulate a shift of the belt when the apparatus is used.

7. An image heating apparatus according to claim 1, wherein the belt is configured to shift only toward the regulation portion.

8. An image heating apparatus according to claim 1, further comprising a spring that applies pressure for forming the nip portion, wherein the nip portion forming unit has a support member configured to reinforce the component, and wherein the spring contacts the support member and directly applies the pressure to the support member.

9. An image heating apparatus according to claim 1, wherein the component has a guide groove configured to mount a frame of the apparatus.

10. An image heating apparatus according to claim 1, further comprising a heater configured to heat the belt.

11. An image heating apparatus according to claim 10, wherein the heater is a part of the nip portion forming unit, and the heater contacts the inner face of the belt.

12. An image heating apparatus according to claim 11, wherein the component is a holder configured to hold the heater.

* * * * *